US008459816B2

(12) United States Patent
Ebert et al.

(10) Patent No.: US 8,459,816 B2
(45) Date of Patent: Jun. 11, 2013

(54) LIGHTING DEVICE FOR OVENS, AND OVEN

(75) Inventors: Hans-Peter Ebert, Dettelbach (DE); Werner Körner, Hettstadt (DE); Martin Meier, Heidenheim (DE); Michaela Reim, Würzburg (DE); Helmut Weinlälader, Würzburg (DE)

(73) Assignees: BSH Bosch und Siemens Hausgeraete GmbH, Munich (DE); Bayerisches Zentrum für Angewandte Energieforschung e.V., Würzburg (DE)

( * ) Notice: Subject to any disclaimer, the term of this patent is extended or adjusted under 35 U.S.C. 154(b) by 716 days.

(21) Appl. No.: 11/992,066

(22) PCT Filed: Sep. 12, 2006

(86) PCT No.: PCT/EP2006/066259

§ 371 (c)(1),
(2), (4) Date: Sep. 12, 2008

(87) PCT Pub. No.: WO2007/031503

PCT Pub. Date: Mar. 22, 2007

(65) Prior Publication Data

US 2009/0071463 A1 Mar. 19, 2009

(30) Foreign Application Priority Data

Sep. 16, 2005 (DE) ..... 10 2005 044 347

(51) Int. Cl.
*F21V 33/00* (2006.01)

(52) U.S. Cl.
USPC ..... 362/92; 362/249.02; 219/390

(58) Field of Classification Search
USPC ..... 362/127, 133, 125, 126, 92, 249.01, 362/249.02, 374, 376; 219/391, 390, 758
See application file for complete search history.

(56) References Cited

U.S. PATENT DOCUMENTS

| | | | | |
|---|---|---|---|---|
| 3,604,783 | A * | 9/1971 | Roth | 362/92 |
| 4,147,947 | A * | 4/1979 | Hoeh | 313/27 |
| 4,259,606 | A * | 3/1981 | Vig | 310/343 |
| 4,410,779 | A * | 10/1983 | Weiss | 219/749 |
| 4,621,180 | A * | 11/1986 | Kristof et al. | 219/758 |
| 4,880,955 | A * | 11/1989 | Nitzinger et al. | 219/758 |
| 5,826,780 | A * | 10/1998 | Neeser et al. | 228/217 |
| 5,836,669 | A | 11/1998 | Hed | |
| 6,361,181 | B1 * | 3/2002 | Bales | 362/92 |
| 7,091,459 | B2 * | 8/2006 | Kim | 219/758 |
| 7,267,450 | B2 * | 9/2007 | Ha | 362/92 |

(Continued)

FOREIGN PATENT DOCUMENTS

| | | |
|---|---|---|
| DE | 79 00 098 U | 7/1979 |
| DE | 34 04 430 | 8/1985 |

(Continued)

OTHER PUBLICATIONS

International Search Report PCT/EP2006/066259

*Primary Examiner* — Hargobind S Sawhney
(74) *Attorney, Agent, or Firm* — James E. Howard; Andre Pallapies

(57) ABSTRACT

A lighting device for an oven having an oven muffle defining an oven muffle chamber is provided. The lighting device includes one light source configured for illuminating the muffle chamber and one partition for separating the light source from the muffle chamber. The lighting device also includes insulation material disposed between the partition and the at least one light source.

25 Claims, 2 Drawing Sheets

U.S. PATENT DOCUMENTS

| | | | | |
|---|---|---|---|---|
| 7,364,322 | B2 * | 4/2008 | Oppor et al. | 362/247 |
| 2004/0264168 | A1 | 12/2004 | Gotz et al. | |
| 2005/0122709 | A1 | 6/2005 | Ha | |
| 2006/0049188 | A1 | 3/2006 | Gramlich et al. | |
| 2006/0091788 | A1 * | 5/2006 | Yan | 313/502 |

FOREIGN PATENT DOCUMENTS

| | | |
|---|---|---|
| DE | 34 45 923 | 8/1985 |
| DE | 86 09 316 U | 6/1986 |
| DE | 38 27 528 | 8/1989 |
| DE | 40 25 734 | 2/1992 |
| DE | 41 00 605 | 7/1992 |
| DE | 103 01 078 | 7/2004 |
| EP | 0 454 969 | 11/1991 |
| EP | 0 922 910 | 6/1999 |
| EP | 0 971 186 | 1/2000 |
| GB | 2 416 202 | 1/2006 |
| WO | WO 2004/088761 | 10/2004 |

* cited by examiner

LIGHTING DEVICE FOR OVENS, AND OVEN

The invention relates to a lighting device for ovens, especially for illuminating the oven muffle, as well to an oven with at least one lighting device.

BACKGROUND OF THE INVENTION

High temperatures prevail during the operation of an oven in the oven muffle or the cooking compartment respectively. Lighting devices which are designed to illuminate the oven muffle must thus be able to withstand such temperatures. Oven lamps with a heat-resistant glass panel cover are provided for this purpose. To attach the oven lamp to the oven muffle a section of the side wall or roof wall of the oven muffle must be cut out. Heat is lost through this cutout in the oven muffle and energy consumption is therefore higher.

In DE 38 27 528 A1 a device is proposed to resolve these problems for illuminating internal compartments of an oven in which the light source is integrated into the front flap door of the oven. The light beams are introduced into the oven muffle in this case directly from the light source or via reflectors. The disadvantage of this type of lighting lies in the fact that it is only made possible from one side, namely the front. Lighting from the direction of view is also basically disadvantageous for good illumination of the texture and thereby of the characteristics of the item being observed, in this case the item being cooked.

SUMMARY OF THE INVENTION

The object of the present invention is to create a facility with which an energy-saving illumination of the oven muffle can be guaranteed.

This object is achieved in accordance with a first aspect of the invention by a lighting device which features at least one light source and at least one partition for separating the light source from the muffle chamber of an oven muffle. The outstanding a feature of the lighting device is that an insulation material is able to be introduced between the partition and the at least one light source.

By providing an insulation material between the partition and the least one of light source a loss of heat from the oven muffle in the area of the lighting device can be prevented. This thus allows the lighting device to be designed to cover a large area without causing a loss of energy. Furthermore, by providing an insulation material separate from the partition, the materials of the partition and of the insulation material can be selected in accordance with the conditions prevailing at these components. Whereas the partition for example has to withstand an attack by high temperatures and simultaneously an attack by steam or vapor, the insulation material can be selected in accordance with its heat-insulating capabilities and its optical attributes. The partition preferably represents a temperature-resistant glass panel. Since the insulation material involves a solid material and not, as in the prior art, air, the insulation material can also assume a support function for supporting the partition. The support for the partition makes it possible to design the latter with a large surface. Bending as a result of thermal changes cannot occur in this case so that the stability and the service life are increased even with large lighting devices.

It is also possible with the inventive lighting device to generate heat insulation which is sufficient to allow light sources which can only withstand low ambient temperatures to be used. A separate cooling of the light source for example via a separate ventilator which is also used for cooling the entire muffle walling can be dispensed with. Such cooling is necessary with conventional lighting devices with an incandescent bulb arranged behind a temperature-resistant glass panel.

A transparent or translucent porous material is preferably used as insulation material. A material with these properties on the one hand allows transfer of heat through convection to be suppressed by the hollow spaces in the porous structure and the solid body heat transfer to be reduced by the small proportion of solids. On the other hand it is possible to guarantee that the light output by the light source will be allowed, to pass through the material.

In accordance with a preferred embodiment the insulation material consists of a silica, i.e. of a silicon dioxide. The silica can be pyrogenic silica, precipitated silica, arced silica or silica aerogel. These materials possess a low thermal conductivity and can thus be used for heat insulation. The particle sizes of these materials can range between 0.5 μm to 10 mm.

Especially preferably the insulation material consists of an aerogel, especially a silica aerogel. Silica aerogel is a highly porous and nanostructured material made from an $SiO_2$ network which has many cavities. Because of its high porosity, silica aerogel exhibits outstanding thermal insulation properties. The high porosity in the nano area leads to both heat conduction through convection being suppressed and also to solid body heat transfer being reduced by the small proportion of solid bodies. In addition silica aerogel possesses a high transparency for visible light. This combination of characteristics means that silica aerogel is especially suitable as an insulation material for the inventive lighting device. Furthermore silica aerogel has a low density so that the lighting device can be manufactured with a low weight and which means that the requirements for attachment via which the lighting device is attached to the inner wall of the oven muffle are low, meaning that the attachment can be designed in a simple manner. Finally silica aerogel has a high density by comparison with other insulation materials, through which the durability of the lighting device and thereby its service life can be increased even if the thickness of the partition is very small.

The insulation material can be provided as loose-fill granular material. This makes it easier to introduce the insulation material between the partition and the at least one light source. In addition, with a loose-fill material the fill density and the distribution of a granulate size in the fill can be set so that the optical properties necessary for the light source used and the temperature conditions can be set. The granulate size to be used here preferably lies between 0.1 mm and 8 mm. Especially preferably a loose-fill material made from granular silica aerogel is used. With this loose-fill material, especially with granulate in the preferred range, a good color rendering can be achieved and thereby a natural assessment of the item being cooked can be guaranteed.

The insulation material, instead of being in the form of a loose-fill of granular material, can also be present in the form of a powder especially a powder fill, or can be introduced between the partition and the at least one light source. In this case for example pyrogenic silica, precipitated silica or arced silica are suitable as the insulation material. With this material the transmission spectrum of the insulation layer can be influenced by the distribution of particle sizes and the type of insulation material. The particle size of the powder can in these cases go down to below 0.5 μm.

In accordance with one embodiment the insulation material is a monolith, especially a silica aerogel monolith.

In accordance with one embodiment an electroluminescence light source is used as the light source. This can be a light foil or a light-emitting diode (LED). The advantage of these light sources on the one hand lies in their ease of manufacture and on the other in the lower energy consumption which is generated by these light sources. The use of LEDs, which as a rule only withstand ambient temperatures of up to 80° C. is made possible in the inventive lighting device since the LEDs are largely decoupled by the insulation material from the internal space of the oven muffle and from the temperatures which prevail there.

Especially when a loose-fill material of silica aerogel is used as the insulation material, further advantages can be obtained in conjunction with the use of an LED as a light source. The emitted light of the LEDs is redistributed by scattering processes in the loose-fill material which means that the disadvantages which occur with conventional use of LEDs can be prevented. Light-emitting diodes may have a high light yield but as a rule they exhibit a clear maximum in the blue spectral range. The reason is the generation of blue light in the semiconductor crystal. This is not desirable in the lighting of an oven. When an insulation material made of nanostructured silica particles is used it has been shown that there is a red shift in the light emitted by the LEDs. This shift to longer wavelengths results from the Rayleigh scattering occurring in the insulation material of the light emitted by the LED. This enables an overall almost natural color rendering to be achieved.

By comparison with incandescent bulbs which are used in conventional lighting devices the light output with the use of an LED can be increased and thereby, at a predetermined minimum lighting level in the oven muffle, the energy requirement can be reduced.

However the invention also makes it possible to use a halogen incandescent lamp as a light source. By using light-emitting diodes as light sources or as illumination means, with a layer of transparent nanostructured silica (silicon dioxide) in front of them, a particularly energy-saving and color-neutral oven lighting can be implemented.

Preferably the partition represents part of a receptacle for the insulation material. The receptacle can be a separate component from the oven which is inserted in or on the walling of the oven muffle. For example the receptacle can consist of two glass panels which are held in a frame. The at least one light source can be incorporated into the receptacle. It is however also possible to incorporate the light sources for example via recesses in the rear wall of the receptacle in the area of the insulation material. By providing a receptacle of which one side is formed by the separate partition optimum conditions for the insulation material can be set, a topic which will be explained in greater detail below. Furthermore the manufacturing and the insertion of the lighting device into the oven muffle is simplified.

One condition which can be set in the receptacle for example is a vacuum. The setting of the operating temperature at the light source or the illumination means respectively as a rule requires a corresponding thickness of the insulating layer or fill density of the insulation material. Such an enlargement of the layer thickness or of the fill material density leads however to a reduction in the transmission of the radiation emitted by the illumination means through the insulation material. By evacuating the enclosure the amount of insulation material and thereby also the thickness of the insulating layer or of the fill material density can be reduced. By this reduction of the gas pressure the gas heat conduction in the cavities of the insulation material is suppressed and the insulation material in the receptacle can in this case take over a support function for the partition, so that even a partition with a large surface can be used without having to increase the wall strength of the partition.

In accordance with a further aspect the invention relates to an oven with a least one lighting device for illuminating the oven muffle. The outstanding feature of the oven is that the at least one lighting device features a partition facing towards the oven muffle and an insulation material provided behind the partition which is provided between the at least one light source and the partition.

The size of the lighting devices is not restricted here as a result of the design of the lighting devices. A plurality of lighting devices can also be provided.

In accordance with an embodiment the oven features at least two lighting devices which are each provided above two respective oven levels lying above one another. This makes it possible to illuminate a number of baking trays simultaneously. By using at the inventive lighting device this illumination can be undertaken with greatly reduced energy losses at the partitions and with a lower energy requirement for the lighting device as a whole.

Preferably the lighting devices are provided on the side walls of the muffle chamber of the oven muffle. The lighting devices are preferably incorporated into the side walls. To this end recesses are provided in the side walls of the muffle chamber. The fact that the lighting devices are provided in recesses on the one hand means that the surface over which heat from the muffle chamber can escape can be minimized and on the other hand the lighting devices do not reduce the inner space of the oven muffle so that its entire size is available for accommodating items to be cooked or baked.

The side arrangement enables the illumination of the oven levels to be optimized. In particular even with a large number of carriers for items to be cooked inserted into the different oven levels, such as baking trays, an illumination of all levels is guaranteed. Even at the top oven level a more even illumination of the oven level can be achieved with the inventive side illumination than is possible with an illumination by an incandescent bulb from above onto the oven level.

The oven preferably features a lighting device in accordance with the invention.

Advantages and features which are described in relation to the lighting device also apply "where applicable" accordingly to the inventive oven and vice-versa.

BRIEF DESCRIPTION OF THE DRAWINGS

The invention is explained once again below with reference to the enclosed drawings. The figures show.

DETAILED DESCRIPTION OF THE EXEMPLARY EMBODIMENTS OF THE PRESENT INVENTION

Figure 1:
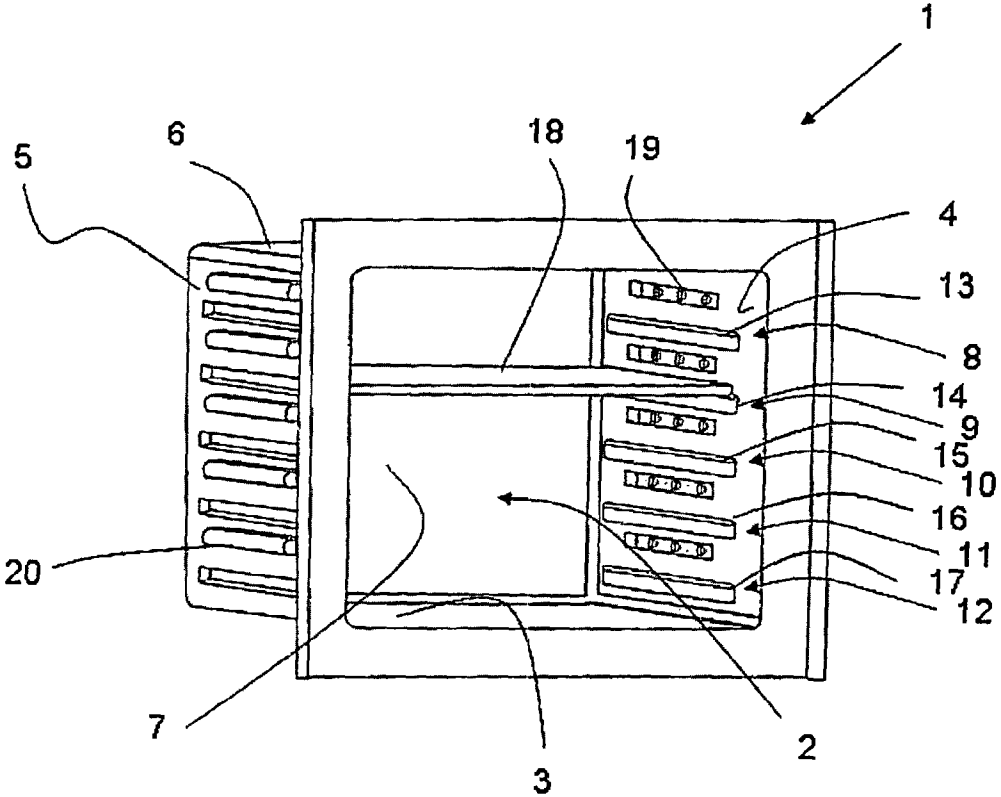
FIG. 1: a schematic perspective view of the oven muffle of an inventive oven.

The oven muffle shown in FIG. 1 is designed in the shape of a cube and is shown without an oven door or front flap. The muffle chamber 2 is delimited by a floor side muffle wall 3, two vertical muffle sidewalls 4 and 5, an upper muffle roof wall 6 and also a rear muffle wall 7. In five oven levels, 8 to 12 lying one above the other, slider rails 13 to 17 are fitted to the side muffle walls 4 and 5 for holding slide-in cooking item carriers, such as the baking tray 18 shown for example.

Between the slider rails 13 to 17 which define the oven levels 8 to 12 and above the upper oven level 8 lighting devices 19 are provided on the side walls 4 and 5 of the muffle chamber 2. The lighting devices 19 are in the form of lighting rails and extend in a horizontal direction along the side walls 4 and 5 from the area of the front of the muffle space to back to the vicinity of the rear muffle wall 7. The lighting devices 19 are accommodated in recesses 20 in the side walls 4 and 5 of the oven muffle 1 and attached there. Preferably the lighting devices 19 are accommodated completely in the recesses 20, meaning that they do not protrude into the muffle chamber 2.

Figure 2:
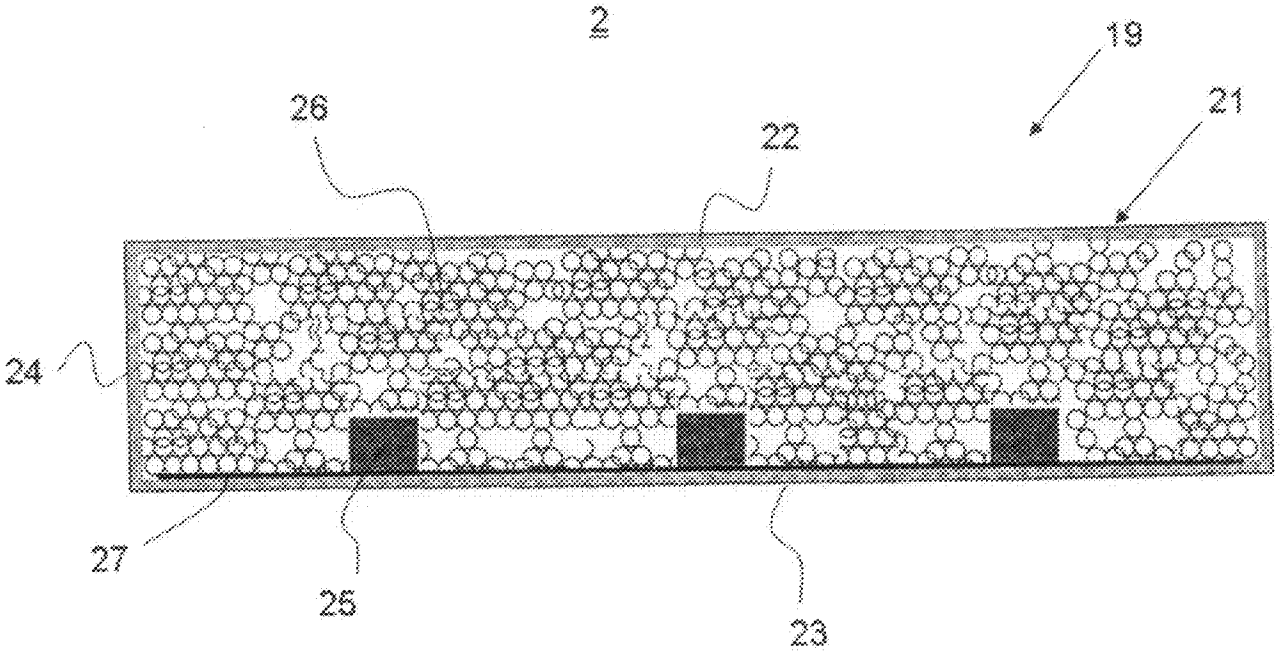
FIG. 2: a schematic sectional view of an embodiment of an inventive lighting device.

The structure of an embodiment of the inventive lighting device will be explained below with reference to FIG. 2.

The lighting device 19 in the embodiment shown comprises a receptacle 21, consisting of a partition 22, a rear wall 23 and a frame 24 carrying these two walls 22 and 23. The frame 24 defines the side walls of the rectangular cross section of the receptacle 21.

Light sources 25 are provided on the rear wall 23 facing the partition 22 of the receptacle 21, with said sources only being depicted schematically in the figure and able to represent LEDs for example. In this embodiment the receptacle 21 is used not only to accommodate the insulation material 26, but also to hold the light sources 25. In the figure three light sources 25 are provided in the receptacle 21. In addition to the actual illumination means these can include a corresponding bracket which is not shown in FIG. 2. The receptacle 21 is filled with an insulation material 26. The insulation material 26 preferably represents a loose-fill material made of silica aerogel. On the rear wall 23 in the embodiment shown, on the side facing the partition 22, a reflection layer 27, especially mirroring, is applied via which a coupling back in of light hitting the rear wall 23 is performed.

In the installed state the partition 22, which especially represents a temperature-resistant glass panel, is facing towards the muffle chamber 2. The frame 24 and the rear wall 23 are accommodated in the recess 20 in the side wall 4 or 5 of the oven muffle 1. The rear wall 23 of the receptacle 21 can be made of glass or of another temperature-resistant material. The frame 24 consists for example of metal.

A reduced gas pressure preferably is provided inside the receptacle 21. For this reason, the transitions between the partition 22 and the frame 24 or the frame 24 and the rear wall 23 respectively are embodied correspondingly gas-tight. For example, a separate sealing mass (not shown) can be used to provide a gas-tight seal. Alternately, the rear wall 23 and the frame 24 can also be embodied in one piece to provide a gas-tight seal.

The light emitted by the light sources 25 is scattered at the insulation material 26. Through this Rayleigh scattering at the insulation material 26 a shift into red light of the color impression of the light entering the muffle chamber 2 occurs.

With this warm white light an illumination of the oven chamber can be achieved which meets the highest demands in optical assessment of cooking items, especially guarantees a good natural color rendering.

By using a silica aerogel or another silica a sufficient luminous intensity of 300 lx can be achieved. In addition to the mean value of the luminous intensity the distribution of the illumination is of significance. In this case an even illumination at a low level is preferable to an uneven illumination at a high level. Also of significance is the equilibrium between diffuse and directed illumination, which is also referred to as modeling below. The general appearance is improved if objects are illuminated so that form and surface structures are recognizable clearly and in a pleasant way. This is achieved if the light perceptibly possesses a preferred direction; the unique shadows which are of importance for good modeling are produced in this way. The illumination should not be too strongly directed since otherwise shadows which are too hard form. It should also not be too diffuse since otherwise the modeling effect is lost and an unattractive lighting ambience is produced. These requirements can be met by using an aerogel, especially a silica aerogel, in conjunction with an LED as light source and simultaneously the further advantages which can be obtained with an aerogel, especially the good heat insulation, can be utilized.

With the present invention it becomes possible to guarantee an illumination of the interior of the oven even when all baking trays are being used at the different levels of the oven. In addition a good assessment of the item being cooked is possible. With the inventive illumination a sufficient average luminous intensity, an acceptable lighting atmosphere, a good color rendering, a low-energy consumption mode of operation of the lighting system and also low-energy operation of the oven because of the good heat insulation can be guaranteed.

The invention claimed is:

1. A lighting device for an oven having an oven muffle defining an oven muffle chamber, said lighting device comprising:

at least one light source configured for illuminating the oven muffle chamber;

at least one temperature-resistant partition for separating the light source from the oven muffle chamber; and insulation material disposed between the partition and the at least one light source, wherein the insulation material supports a side of the temperature-resistant partition facing the at least one light source and fills a space between the at least one light source and the side of the temperature-resistant partition to prevent loss of heat from the oven muffle chamber through the lighting device and insulate the at least one light source from the heat from the oven muffle chamber, and wherein the insulation material permits light from the at least one light source to pass through the insulation material.

2. The lighting device according to claim 1, wherein the insulation material is formed from one of a transparent heat insulation material and a translucent heat insulation material.

3. The lighting device according claim 1 wherein the insulation material is formed from silica.

4. The lighting device according claim 1 wherein the insulation material is formed from silica aerogel.

5. The lighting device according claim 1 wherein the insulation material is formed from a granular material.

6. The lighting device according claim 1 wherein the insulation material is in powder form.

7. The lighting device according claim 1 wherein the insulation material is formed as a monolith.

8. The lighting device according claim 1 wherein the at least one light source includes an electroluminescent light source.

9. The lighting device according claim 8 wherein the electroluminescent light source includes a light-emitting diode (LED).

10. The lighting device according claim 1 wherein the partition forms at least a portion of a receptacle for the insulation material.

11. The lighting device according to claim 10 wherein an atmosphere within the receptacle is at a lower gas pressure than a gas pressure of an atmosphere of an area surrounding the receptacle.

12. The lighting device of claim 1, wherein the at least one temperature-resistant partition includes a temperature-resistant glass panel.

13. An oven comprising:

an oven muffle defining a muffle chamber; and at least one lighting device coupled to a recess in a wall of the muffle chamber, the at least one lighting device including:

at least one light source for illuminating the oven muffle;

a temperature-resistant partition directed toward the muffle chamber and in the recess in the wall of the muffle chamber; and an insulation material disposed behind the temperature-resistant partition, wherein the insulation material supports a side of the temperature-resistant partition facing the at least one light source, and wherein the insulation material fills a space between the at least one light source and the side of the temperature-resistant partition to prevent loss of heat from the muffle chamber through the lighting device and insulate the at least one light source from the heat from the muffle chamber, and wherein the insulation material permits light from the at least one light source to pass through the insulation material.

14. The oven according to claim 13 wherein the oven further comprises two oven levels lying one above the other and at least two lighting devices disposed above the two oven levels.

15. The oven according claim 13 wherein the at least one lighting device is disposed on a side wall of the oven muffle.

16. The oven according claim 13 wherein the at least one lighting device includes at least one light source configured for illuminating the muffle chamber.

17. The lighting device of claim 1, comprising:

a receptacle including a frame that supports a rear wall and the at least one temperature-resistant partition, wherein the at least one light source is in the receptacle, and wherein the insulation material fills the receptacle.

18. The oven of claim 13, wherein the at least one lighting device includes a receptacle having a frame that supports a rear wall and the at least one temperature-resistant partition, wherein the at least one light source is in the receptacle, and wherein the insulation material fills the receptacle.

19. The oven of claim 18, wherein the insulation material includes one of a transparent heat insulation material and a translucent heat insulation material.

20. The oven of claim 18, wherein the insulation material includes silica.

21. The oven of claim 18, wherein the insulation material includes silica aerogel.

22. The oven of claim 18, wherein the insulation material includes a granular material.

23. The oven of claim 18, wherein the insulation material includes a powder form insulation material.

24. The oven of claim 18, wherein the insulation material includes a monolith insulation material.

25. The oven of claim 13, wherein the at least one temperature-resistant partition includes a temperature-resistant glass panel.

* * * * *

UNITED STATES PATENT AND TRADEMARK OFFICE

CERTIFICATE OF CORRECTION

PATENT NO. : 8,459,816 B2
APPLICATION NO. : 11/992066
DATED : June 11, 2013
INVENTOR(S) : Ebert et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 994 days.

Signed and Sealed this
Eighth Day of September, 2015

Michelle K. Lee

Michelle K. Lee
*Director of the United States Patent and Trademark Office*